US011454473B2

(12) United States Patent
York et al.

(10) Patent No.: US 11,454,473 B2
(45) Date of Patent: Sep. 27, 2022

(54) TELESCOPIC SIGHT HAVING BALLISTIC GROUP STORAGE

(71) Applicant: Sig Sauer, Inc., Newington, NH (US)

(72) Inventors: Andrew W. York, Portland, OR (US); Luke C. Corbin, Beaverton, OR (US)

(73) Assignee: SIG SAUER, INC., Newington, NH (US)

( * ) Notice: Subject to any disclaimer, the term of this patent is extended or adjusted under 35 U.S.C. 154(b) by 0 days.

(21) Appl. No.: 17/152,721

(22) Filed: Jan. 19, 2021

(65) Prior Publication Data

US 2021/0247163 A1 Aug. 12, 2021

Related U.S. Application Data

(60) Provisional application No. 62/962,465, filed on Jan. 17, 2020.

(51) Int. Cl.
*F41G 1/473* (2006.01)
*F41G 1/34* (2006.01)

(52) U.S. Cl.
CPC ..... *F41G 1/473* (2013.01); *F41G 1/345* (2013.01)

(58) Field of Classification Search
CPC ..... F41G 1/38
See application file for complete search history.

(56) References Cited

U.S. PATENT DOCUMENTS 1,107,163 A 8/1914 Grauheding
1,127,230 A 2/1915 Grauheding
1,190,121 A 7/1916 Critchett
1,708,389 A 4/1929 Karnes
1,724,093 A 8/1929 Kauch et al.
1,803,939 A 5/1931 Karnes
1,989,697 A 2/1935 Knisley
2,154,454 A 4/1939 Joyce
2,162,723 A 6/1939 Karnes
2,171,571 A 9/1939 Karnes
2,250,179 A 7/1941 Brown
2,253,948 A 8/1941 Brown
(Continued)

FOREIGN PATENT DOCUMENTS

CA 2589391 C 2/2010
CA 2773537 A1 11/2011
(Continued)

OTHER PUBLICATIONS

International Search Report and Written Opinion of the International Searching Authority issued in International Application No. PCT/US2021/014015, dated Apr. 21, 2021, 11 pages.

*Primary Examiner* — J. Woodrow Eldred
(74) *Attorney, Agent, or Firm* — Miller Nash LLP

(57) ABSTRACT

A riflescope that stores several grouped ballistics data includes a reticle having individually addressable indicators, a memory that stores two or more stored sets of ballistics data, where each set of ballistics data is mapped to a respective set of indicators of the reticle, a selector configured to choose one of the stored sets of ballistics data as an active set of ballistics data, and a driver structured to energize only those indicators of the plurality of indicators that are mapped to the active set of ballistics data. Methods of selecting an active group of ballistics data are also described.

15 Claims, 11 Drawing Sheets

(56) References Cited

U.S. PATENT DOCUMENTS 2,355,920 A 8/1944 Marston
2,363,523 A 11/1944 Greenblatt, Jr. et al.
2,372,613 A 3/1945 Antonin
2,404,302 A 7/1946 Land et al.
2,420,252 A 5/1947 Land
2,433,843 A 1/1948 Hammond et al.
2,450,712 A 10/1948 Brown
2,455,963 A 12/1948 Roed
2,464,195 A 3/1949 Burley et al.
2,504,168 A 4/1950 Rood
2,534,225 A 12/1950 Brown
2,538,253 A 1/1951 Emory et al.
2,586,807 A 2/1952 Fowler
2,596,522 A 5/1952 Bethke
2,609,606 A 9/1952 Draper et al.
2,690,014 A 9/1954 Draper et al.
2,734,273 A 2/1956 Blindenbacher et al.
2,737,652 A 3/1956 White et al.
2,806,287 A 9/1957 Sullivan
2,811,894 A 11/1957 Braker
2,878,466 A 3/1959 Shank et al.
2,949,816 A 8/1960 Weaver
2,963,788 A 12/1960 Luboshez
2,964,991 A 12/1960 Coeytaux et al.
3,059,338 A 10/1962 Coeytaux
3,097,432 A 7/1963 Shaw
3,121,134 A 2/1964 Heinzel
3,169,726 A 2/1965 Jackson
3,190,003 A 6/1965 O'brien
3,199,197 A 8/1965 Macleod et al.
3,286,352 A 11/1966 Schray
3,340,614 A 9/1967 Leatherwood
3,381,380 A 5/1968 Thomas
3,383,987 A 5/1968 Macmillan
3,392,450 A 7/1968 Herter et al.
3,431,652 A 3/1969 Leatherwood
3,492,733 A 2/1970 Leatherwood
3,568,324 A 3/1971 Jorczak
3,682,552 A 8/1972 Hartman
3,744,133 A 7/1973 Fukushima et al.
3,782,822 A 1/1974 Spence
3,948,587 A 4/1976 Rubber
4,205,916 A 6/1980 Vogl et al.
4,263,719 A 4/1981 Murdoch
4,285,137 A 8/1981 Jennie
4,312,262 A 1/1982 Tye
4,403,421 A 9/1983 Shepherd
4,497,548 A 2/1985 Burris
4,531,052 A 7/1985 Moore
4,561,204 A 12/1985 Binion
4,584,776 A 4/1986 Shepherd
4,618,221 A 10/1986 Thomas
4,671,165 A 6/1987 Heidmann et al.
4,720,804 A 1/1988 Moore
4,743,765 A 5/1988 Ekstrand
4,777,352 A 10/1988 Moore
4,777,861 A 10/1988 Lecuyer et al.
4,787,739 A 11/1988 Gregory
4,806,007 A 2/1989 Bindon
4,912,853 A 4/1990 McDonnell et al.
4,945,646 A 8/1990 Ekstrand
4,965,439 A 10/1990 Moore
5,005,308 A 4/1991 Parks
5,026,158 A 6/1991 Golubic
5,068,969 A 12/1991 Siebert
5,181,323 A 1/1993 Cooper
5,355,224 A 10/1994 Wallace
5,375,072 A 12/1994 Cohen
5,413,029 A 5/1995 Gent et al.
5,456,157 A 10/1995 Lougheed et al.
5,491,546 A 2/1996 Wascher et al.
RE35,409 E 12/1996 Moore
5,783,825 A 7/1998 Wiese
5,822,713 A 10/1998 Profeta
5,901,452 A 5/1999 Clarkson
5,920,995 A 7/1999 Sammut
5,973,315 A 10/1999 Saldana et al.
6,032,374 A 3/2000 Sammut
6,111,692 A 8/2000 Sauter
6,247,259 B1 6/2001 Tsadka et al.
6,269,581 B1 8/2001 Groh
6,357,158 B1 3/2002 Smith
6,453,595 B1 9/2002 Sammut
6,516,551 B2 2/2003 Gaber
6,516,699 B2 2/2003 Sammut et al.
6,591,537 B2 7/2003 Smith
6,681,512 B2 1/2004 Sammut
6,729,062 B2 5/2004 Thomas et al.
6,802,131 B1 10/2004 Scholz et al.
6,886,287 B1 5/2005 Bell et al.
6,978,569 B2 12/2005 Williamson, IV et al.
7,069,684 B2 7/2006 Smith
7,171,775 B1 2/2007 LaCorte
7,171,776 B2 2/2007 Staley
7,185,455 B2 3/2007 Zaderey
7,194,838 B2 3/2007 Smith
D542,879 S 5/2007 Zaderey
7,222,452 B2 5/2007 Smith
7,225,578 B2 6/2007 Tai
7,237,355 B2 7/2007 Smith
7,269,920 B2 9/2007 Staley
7,292,262 B2 11/2007 Towery et al.
7,296,358 B1 11/2007 Murphy et al.
7,325,353 B2 2/2008 Cole et al.
7,325,354 B2 2/2008 Grauslys et al.
7,328,531 B2 2/2008 Dietz
7,343,707 B2 3/2008 Smith
7,350,329 B1 4/2008 Bell et al.
7,386,953 B2 6/2008 Ball
7,421,816 B2 9/2008 Conescu
7,490,430 B2 2/2009 Staley
7,516,571 B2 4/2009 Scrogin et al.
7,530,192 B2 5/2009 Grauslys et al.
7,584,570 B2 9/2009 Smith
7,603,804 B2 10/2009 Zaderey et al.
7,624,528 B1 12/2009 Bell et al.
7,654,029 B2 2/2010 Peters et al.
7,658,031 B2 2/2010 Cross et al.
7,690,145 B2 4/2010 Peters et al.
7,703,679 B1 4/2010 Bennetts et al.
7,703,719 B1 4/2010 Bell et al.
7,705,975 B1 4/2010 Farris
7,738,082 B1 6/2010 Peters
7,748,155 B2 7/2010 Cole
7,752,798 B2 7/2010 Mayerle
7,764,434 B2 7/2010 Håkansson et al.
7,793,456 B1 9/2010 LaCorte
7,806,331 B2 10/2010 Windauer et al.
7,832,137 B2 11/2010 Sammut et al.
7,836,626 B2 11/2010 Shepherd
7,856,750 B2 12/2010 Sammut et al.
7,877,886 B1 2/2011 Hamilton
7,905,046 B2 3/2011 Smith, III
7,937,878 B2 5/2011 Sammut et al.
8,001,714 B2 8/2011 Davidson
8,006,429 B2 8/2011 Windauer
8,033,464 B2 10/2011 Windauer et al.
8,046,951 B2 11/2011 Peters et al.
8,051,597 B1 11/2011 D'Souza et al.
8,056,281 B2 11/2011 Staley
8,074,394 B2 12/2011 Lowrey
8,081,298 B1 12/2011 Cross
8,091,268 B2 1/2012 York
8,109,029 B1 2/2012 Sammut et al.
8,172,139 B1 5/2012 McDonald et al.
8,196,828 B2 6/2012 Kelly
8,201,741 B2 6/2012 Bennetts et al.
8,230,635 B2 7/2012 Sammut et al.
8,281,995 B2 10/2012 Bay
8,282,493 B2 10/2012 Román et al.
8,286,384 B2 10/2012 Zaderey et al.
8,314,923 B2 11/2012 York et al.
8,317,100 B2 11/2012 Windauer et al.
8,336,776 B2 12/2012 Horvath et al.

(56) References Cited

U.S. PATENT DOCUMENTS 8,353,454 B2 1/2013 Sammut et al.
8,365,455 B2 2/2013 Davidson
8,375,620 B2 2/2013 Staley
8,408,460 B2 4/2013 Schneider et al.
8,414,298 B2 4/2013 D'Souza et al.
8,448,372 B2 5/2013 Peters et al.
8,453,368 B2 6/2013 Bockmon
8,468,930 B1 6/2013 Bell
8,500,563 B2 8/2013 Román et al.
8,516,736 B2 8/2013 Windauer
8,584,944 B2 11/2013 White et al.
8,608,069 B1 12/2013 Bay
8,656,630 B2 2/2014 Sammut
8,701,330 B2 4/2014 Tubb
8,705,173 B2 4/2014 Peters et al.
8,707,608 B2 4/2014 Sammut et al.
D709,588 S 7/2014 Silvers et al.
8,807,430 B2 8/2014 Millett
8,833,655 B2 9/2014 McCarty et al.
8,881,981 B2 11/2014 Millett
8,893,423 B2 11/2014 Tubb
8,893,971 B1 11/2014 Sammut et al.
8,905,307 B2 12/2014 Sammut et al.
8,910,412 B2 12/2014 Mikroulis
8,919,647 B2 12/2014 Chen et al.
8,959,823 B2 2/2015 Peters et al.
8,959,824 B2 2/2015 Sammut et al.
8,966,806 B2 3/2015 Sammut et al.
8,991,702 B1 3/2015 Sammut et al.
9,004,358 B2 4/2015 Bay
9,033,232 B2 5/2015 Bockmon
9,038,307 B2 5/2015 Silvers et al.
9,038,901 B2 5/2015 Paterson et al.
9,057,587 B2 6/2015 Roman et al.
9,068,794 B1 6/2015 Sammut
9,068,795 B2 6/2015 Roman et al.
9,074,845 B2 7/2015 Wiklund
9,091,507 B2 7/2015 Paterson et al.
9,110,295 B2 8/2015 Lupher et al.
9,115,956 B2 8/2015 Hakanson et al.
9,115,958 B2 8/2015 Crispin
9,121,672 B2 9/2015 Tubb
9,127,907 B2 9/2015 Lupher et al.
9,127,909 B2 9/2015 Ehrlich
9,127,910 B2 9/2015 Volfson
9,127,911 B2 9/2015 Varshneya et al.
9,140,521 B2 9/2015 Millett
9,151,574 B2 10/2015 Lowrey
9,157,701 B2 10/2015 Varshneya et al.
9,175,927 B2 11/2015 Tubb
9,194,880 B2 11/2015 Kremer
9,212,868 B2 12/2015 Roman et al.
9,239,213 B2 1/2016 Chen et al.
9,250,035 B2 2/2016 Sullivan et al.
9,250,036 B2 2/2016 Farca et al.
9,250,038 B2 2/2016 Sammut et al.
9,255,771 B2 2/2016 Sammut et al.
9,285,187 B2 3/2016 Stockdill
9,292,034 B2 3/2016 Windauer
D753,785 S 4/2016 Silvers et al.
9,310,163 B2 4/2016 Bay
9,310,165 B2 4/2016 Bell et al.
9,335,120 B2 5/2016 Roman et al.
9,335,123 B2 5/2016 Sammut
9,347,742 B2 5/2016 Varshneya et al.
9,395,155 B1 7/2016 Bockmon
9,429,653 B2 8/2016 Volfson
9,429,745 B2 8/2016 Brumfield
9,435,610 B2 9/2016 Silvers et al.
9,459,077 B2 10/2016 Sammut et al.
9,464,871 B2 10/2016 Bay
9,466,120 B2 10/2016 Maryfield et al.
9,482,488 B2 11/2016 Moyle
9,482,489 B2 11/2016 Peters et al.
9,482,516 B2 11/2016 McCarthy et al.
9,500,444 B2 11/2016 Sammut et al.
9,518,804 B2 12/2016 Hamilton
9,557,142 B2 1/2017 Tubb
9,568,277 B2 2/2017 Crispin
9,568,279 B2 2/2017 Maryfield et al.
9,574,849 B2 2/2017 Hakanson et al.
9,574,850 B2 2/2017 Sammut et al.
9,581,415 B2 2/2017 Tubb
9,593,907 B2 3/2017 Regan et al.
9,612,086 B2 4/2017 Sammut et al.
9,651,338 B2 5/2017 Theisinger
9,665,120 B2 5/2017 Windauer
9,677,848 B2 6/2017 Hamilton
9,677,851 B2 6/2017 Hancosky
9,678,099 B2 6/2017 Maryfield et al.
9,678,208 B2 6/2017 Volfson
9,689,643 B2 6/2017 Farca et al.
9,777,992 B2 10/2017 McRee
9,874,421 B2 1/2018 Stockdill
10,145,652 B2 12/2018 Paterson et al.
10,288,380 B1 5/2019 York
2004/0148841 A1 8/2004 Burzel
2005/0241207 A1 11/2005 Staley
2005/0257414 A1 11/2005 Zaderey et al.
2007/0056203 A1 3/2007 Gering et al.
2007/0097351 A1 5/2007 York et al.
2007/0137088 A1 6/2007 Peters et al.
2007/0144052 A1 6/2007 Smith
2007/0197314 A1 8/2007 York et al.
2008/0098640 A1 5/2008 Sammut et al.
2008/0104875 A1 5/2008 Mayerle
2009/0183417 A1 7/2009 Smith
2009/0199451 A1 8/2009 Zaderey et al.
2009/0199453 A1 8/2009 Cross et al.
2011/0021293 A1 1/2011 York et al.
2011/0271577 A1 11/2011 Davidson
2011/0296733 A1 12/2011 York
2012/0132709 A1 5/2012 Lowrey
2012/0145785 A1 6/2012 Scrogin et al.
2012/0217300 A1 8/2012 McDonald et al.
2013/0014421 A1 1/2013 Sammut et al.
2014/0000146 A1 1/2014 Davidson
2014/0041277 A1 2/2014 Hamilton
2014/0063261 A1 3/2014 Betensky et al.
2014/0101982 A1 4/2014 McPhee
2014/0110482 A1 4/2014 Bay
2014/0123534 A1 5/2014 Hodnett
2014/0166750 A1 6/2014 Chen et al.
2014/0166751 A1 6/2014 Sammut et al.
2014/0184476 A1 7/2014 McHale et al.
2014/0231014 A1 8/2014 Davidson
2014/0339307 A1 11/2014 Sammut et al.
2014/0370993 A1 12/2014 Roman et al.
2014/0373424 A1 12/2014 Silvers et al.
2015/0106046 A1 4/2015 Chen et al.
2015/0153139 A1 6/2015 Davidson
2015/0176948 A1 6/2015 Varshneya et al.
2015/0198410 A1 7/2015 McRee
2015/0276346 A1 10/2015 Hamilton et al.
2015/0323780 A1 11/2015 Hamilton
2016/0010949 A1 1/2016 Teetzel et al.
2016/0010950 A1 1/2016 Sammut et al.
2016/0025455 A1 1/2016 Paterson et al.
2016/0069640 A1* 3/2016 Pretorius ..... F41G 3/065 42/122
2016/0091282 A1 3/2016 Baker et al.
2016/0109210 A1 4/2016 Lupher et al.
2016/0138890 A1 5/2016 Hofmann et al.
2016/0163080 A1 6/2016 Baker et al.
2016/0169625 A1 6/2016 Richards
2016/0202021 A1 7/2016 Roman et al.
2016/0202960 A1 7/2016 Le et al.
2016/0223293 A1 8/2016 Maryfield et al.
2016/0252325 A1 9/2016 Sammut et al.
2016/0265880 A1 9/2016 Maryfield et al.
2016/0327367 A1 11/2016 Porter et al.
2016/0370147 A1 12/2016 Hancosky
2016/0377379 A1 12/2016 Roman et al.
2016/0377380 A1 12/2016 Sammut

(56) References Cited

U.S. PATENT DOCUMENTS

| | | | |
|---|---|---|---|
| 2017/0082400 | A1 | 3/2017 | York et al. |
| 2017/0108376 | A1 | 4/2017 | Maryfield et al. |
| 2017/0138698 | A1 | 5/2017 | York et al. |
| 2017/0254619 | A1 | 9/2017 | McRee |
| 2017/0343317 | A1 | 11/2017 | VanBecelaere |
| 2019/0072364 | A1 | 3/2019 | VanBecelaere et al. |
| 2019/0219813 | A1* | 7/2019 | Summerfield ..... F41G 3/06 |

FOREIGN PATENT DOCUMENTS

| | | | |
|---|---|---|---|
| CA | 2784280 | A1 | 11/2011 |
| CA | 2743103 | C | 10/2013 |
| CA | 2904485 | A1 | 8/2014 |
| CA | 2847309 | A1 | 9/2014 |
| CA | 2767420 | C | 12/2014 |
| CA | 2660897 | C | 6/2015 |
| CA | 2858582 | C | 6/2015 |
| DE | 726699 | C | 10/1942 |
| DE | 2000614 | A1 | 7/1971 |
| DE | 2736598 | A1 | 2/1978 |
| DE | 2652120 | A1 | 5/1978 |
| DE | 3219940 | A1 | 12/1983 |
| DE | 3622901 | A1 | 1/1988 |
| DE | 19846655 | A1 | 4/1999 |
| DE | 102004034267 | A1 | 2/2006 |
| DE | 202005017276 | U1 | 3/2006 |
| DE | 112007000314 | T5 | 1/2009 |
| DE | 102008053948 | A1 | 5/2009 |
| DE | 102013217240 | A1 | 3/2014 |
| DE | 102013012257 | A1 | 1/2015 |
| EP | 0359950 | B1 | 5/1994 |
| EP | 0605290 | B1 | 1/1997 |
| EP | 0844457 | A2 | 5/1998 |
| EP | 1007995 | A1 | 6/2000 |
| EP | 1057201 | A1 | 12/2000 |
| EP | 1436568 | A2 | 7/2004 |
| EP | 1443354 | A1 | 8/2004 |
| EP | 1690060 | A2 | 8/2006 |
| EP | 1725890 | A1 | 11/2006 |
| EP | 1748273 | A1 | 1/2007 |
| EP | 1801614 | A2 | 6/2007 |
| EP | 1804017 | A1 | 7/2007 |
| EP | 1943681 | A2 | 7/2008 |
| EP | 1969302 | A2 | 9/2008 |
| EP | 1723382 | B1 | 11/2008 |
| EP | 2008049 | A2 | 12/2008 |
| EP | 1723383 | B1 | 9/2009 |
| EP | 2148165 | A2 | 1/2010 |
| EP | 2276050 | A2 | 1/2011 |
| EP | 2276050 | A3 | 1/2011 |
| EP | 2339286 | A2 | 6/2011 |
| EP | 2402704 | A1 | 1/2012 |
| EP | 1516151 | B1 | 6/2012 |
| EP | 2475950 | A2 | 7/2012 |
| EP | 1817538 | B1 | 3/2013 |
| EP | 2659218 | A2 | 11/2013 |
| EP | 2513591 | B1 | 2/2014 |
| EP | 2694908 | A2 | 2/2014 |
| EP | 2739933 | A2 | 6/2014 |
| EP | 1646837 | B1 | 8/2014 |
| EP | 2778739 | A1 | 9/2014 |
| EP | 2781875 | A2 | 9/2014 |
| EP | 2802837 | A1 | 11/2014 |
| EP | 2452151 | B1 | 3/2015 |
| EP | 2943735 | A2 | 11/2015 |
| EP | 2956733 | A1 | 12/2015 |
| EP | 2676098 | B1 | 2/2016 |
| EP | 1038149 | B1 | 4/2016 |
| EP | 3036504 | A1 | 6/2016 |
| EP | 3084338 | A1 | 10/2016 |
| EP | 3102905 | A2 | 12/2016 |
| EP | 2811252 | B1 | 1/2017 |
| EP | 3111155 | A2 | 1/2017 |
| EP | 2536995 | B1 | 10/2017 |
| FR | 1388007 | A | 2/1965 |
| FR | 2699658 | A1 | 6/1994 |
| FR | 2700840 | B1 | 4/1996 |
| GB | 2094950 | A | 9/1982 |
| GB | 2420867 | B | 2/2008 |
| JP | S5536823 | A | 3/1980 |
| TW | I485630 | B | 5/2015 |
| WO | 2006060007 | A1 | 6/2006 |
| WO | 2015095614 | A1 | 6/2015 |
| WO | 2015156899 | A2 | 10/2015 |
| WO | 2016018478 | A2 | 2/2016 |
| WO | 2016018478 | A3 | 3/2016 |
| WO | 2016145122 | A1 | 9/2016 |
| WO | 2016145123 | A1 | 9/2016 |
| WO | 2016145124 | A2 | 9/2016 |
| WO | 2016145124 | A3 | 11/2016 |
| WO | 2017205867 | A1 | 11/2017 |

* cited by examiner

| GROUP 1 | | |
|---|---|---|
| Zero Distance: 100 Yards | | |
| Cartridge | Projectile Weight (gr) | Muzzle Velocity (fps) |
| .243 Win | 70 | 3553 |
| .243 Win | 55 | 3880 |
| .26 Nosler | 100 | 3674 |
| .26 Nosler | 120 | 3550 |
| .26 Nosler | 125 | 3450 |
| .26 Nosler | 140 | 3210 |
| .204 Ruger | 32 | 4225 |

| GROUP 2 | | |
|---|---|---|
| Zero Distance: 100 Yards | | |
| Cartridge | Projectile Weight (gr) | Muzzle Velocity (fps) |
| .300 WBY Mag | 150 | 3375 |
| .338 Lapua | 285 | 2890 |
| .338 Win Mag | 200 | 2950 |
| .338 Rum | 250 | 2900 |
| .270 Weatherby | 130 | 3200 |
| .338 Lapua | 250 | 3000 |
| 7mm Rem Mag | 150 | 3050 |
| .270 WM | 130 | 3275 |
| 7mm Rem Mag | 150 | 3000 |
| 7mm WSM | 140 | 3225 |
| .30-.378 WBY | 180 | 3400 |
| .300 RUM | 180 | 3400 |
| .270 WSM | 150 | 3120 |
| 7mm STW | 140 | 3325 |
| 7mm RUM | 160 | 3250 |
| 7mm RUM | 140 | 3450 |

FIG. 4A

| GROUP 3 | | |
|---|---|---|
| Zero Distance: 100 Yards | | |
| Cartridge | Projectile Weight (gr) | Muzzle Velocity (fps) |
| .300 WinMag | 180 | 2933 |
| .300 WSM | 180 | 2950 |
| .338 Win Mag | 250 | 2700 |
| .300 Win Mag | 150 | 3300 |
| .300 Win Mag | 180 | 2960 |
| .300 WSM | 150 | 3300 |
| .375 HGH | 270 | 2700 |
| .270 Win | 130 | 3050 |
| .270 Win | 140 | 2950 |
| .300 WBY Mag | 180 | 3100 |
| 6mm Creedmoor | 107 | 2950 |
| 30-06 SPRG. | 165 | 2950 |

| GROUP 4 | | |
|---|---|---|
| Zero Distance: 100 Yards | | |
| Cartridge | Projectile Weight (gr) | Muzzle Velocity (fps) |
| 6.5x55 Swedish | 129 | 2750 |
| .25-06 Remington | 120 | 3000 |
| .280 Remington | 140 | 3000 |
| .338 Win Mag | 225 | 2800 |
| .243 Win | 100 | 2900 |
| .223 Remington | 40 | 3650 |
| 260 Remington | 130 | 2820 |
| 6.5 Creedmoor | 130 | 2850 |
| 6.5 Creedmoor | 147 | 2695 |
| 6.5 Creedmoor | 140 | 2742 |
| .25-06 Remington | 100 | 3200 |

FIG. 4B

| GROUP 5 | | |
|---|---|---|
| Zero Distance: 100 Yards | | |
| Cartridge | Projectile Weight (gr) | Muzzle Velocity (fps) |
| .22-250 Remington | 55 | 3650 |
| .375 HGH | 300 | 2600 |
| .308 Win | 175 | 2640 |
| .30-06 Springfield | 180 | 2675 |
| .260 Remington | 120 | 2880 |
| .260 Remington | 140 | 2750 |
| 6.5 Creedmoor | 120 | 2825 |
| .30-06 Springfield | 150 | 3000 |
| .270 Win | 150 | 2850 |

| GROUP 6 | | |
|---|---|---|
| Zero Distance: 100 Yards | | |
| Cartridge | Projectile Weight (gr) | Muzzle Velocity (fps) |
| 5.56mm | 62 | 2822 |
| .223 Remington | 55 | 3200 |
| 7.62x51 | 147 | 2820 |
| .303 British | 150 | 2700 |
| .308 Win | 165 | 2700 |
| .308 Win | 168 | 2700 |
| .308 Win | 175 | 2600 |

| GROUP 7: MUZZLELOADER | | |
|---|---|---|
| Zero Distance: 50 Yards | | |
| Projectile | Projectile Weight (gr) | Muzzle Velocity (fps) |
| .50 cal sabot | 400 | 1900 |

| GROUP 8: CROSSBOW | | |
|---|---|---|
| Zero Distance: 20 Yards | | |
| Bolt | Projectile Weight (gr) | Muzzle Velocity (fps) |
| Bolt | 400 | 350 |

FIG. 5

TELESCOPIC SIGHT HAVING BALLISTIC GROUP STORAGE

CROSS-REFERENCE TO RELATED APPLICATIONS

This application is a non-provisional of and claims benefit to U.S. provisional patent application No. 62/962,465, filed Jan. 17, 2020, entitled TELESCOPIC SIGHT HAVING BALLISTIC GROUP STORAGE, the disclosure of which is incorporated herein by reference in its entirety.

FIELD

This disclosure relates to a telescopic sight for a firearm, and, more particularly, to an electronic telescopic sight that includes a system and memory for storing and grouping one or more ballistic groups, and for displaying a set of indicators on a reticle based on the selected ballistic group.

BACKGROUND

Riflescopes are mounted to rifles to assist a user, or shooter, in aiming the rifle to hit a desired target. Riflescopes may include reticles, which are markings or other indicators that appear in the field of view superimposed over the image of target through the riflescope. Reticles may include horizontal and vertical crosshairs and may include a central intersection point that can be calibrated to coincide with the point of impact of a projectile from the rifle. This central aiming point of the reticle may be zeroed-in at a particular zero range distance and then adjusted for different ranges and conditions using elevation and windage turrets to make slight adjustments to its vertical and horizontal position relative to the rifle. In this way, the user may generally use the central intersection point of the crosshairs to aim the riflescope, and thus, the rifle.

Some digital scopes and related systems are programmable to a particular cartridge and environment in which user is shooting. Input systems for entering all of the various ballistic variables to be stored in the digital scope can be complex, or require the user to use a computer application as well as a rangefinder to enter such information.

Embodiments of the disclosure address these and other limitations of the art.

BRIEF DESCRIPTION OF THE DRAWINGS

FIGS. 4A and 4B are charts of various cartridge loads and their corresponding groups as stored on the riflescope of FIG. 1.

FIG. 5 is a chart of other various cartridge loads and their corresponding groups as stored on the riflescope of FIG. 1.

DETAILED DESCRIPTION

In embodiments, a riflescope includes multiple pre-stored ballistic groups that are individually selectable by the user. A ballistic group is a set of cartridges or cartridge types that share common ballistic characteristics. In general, each of the specific cartridges in a particular group will exhibit a similar amount of ballistic drop when fired from a firearm. Selecting a particular ballistics group may be easier than entering in all the cartridge information for a particular single cartridge, such as caliber, projectile weight, initial muzzle velocity, ballistic coefficient, etc. Instead, a user may consult information to determine which ballistic group the desired cartridge is in, and then merely select the ballistic group that includes the desired cartridge. A particular riflescope may preferably include 2-20 ballistics groups and more preferably 4-10 groups. In some embodiments the scope may store more or fewer groups.

Figure 1:
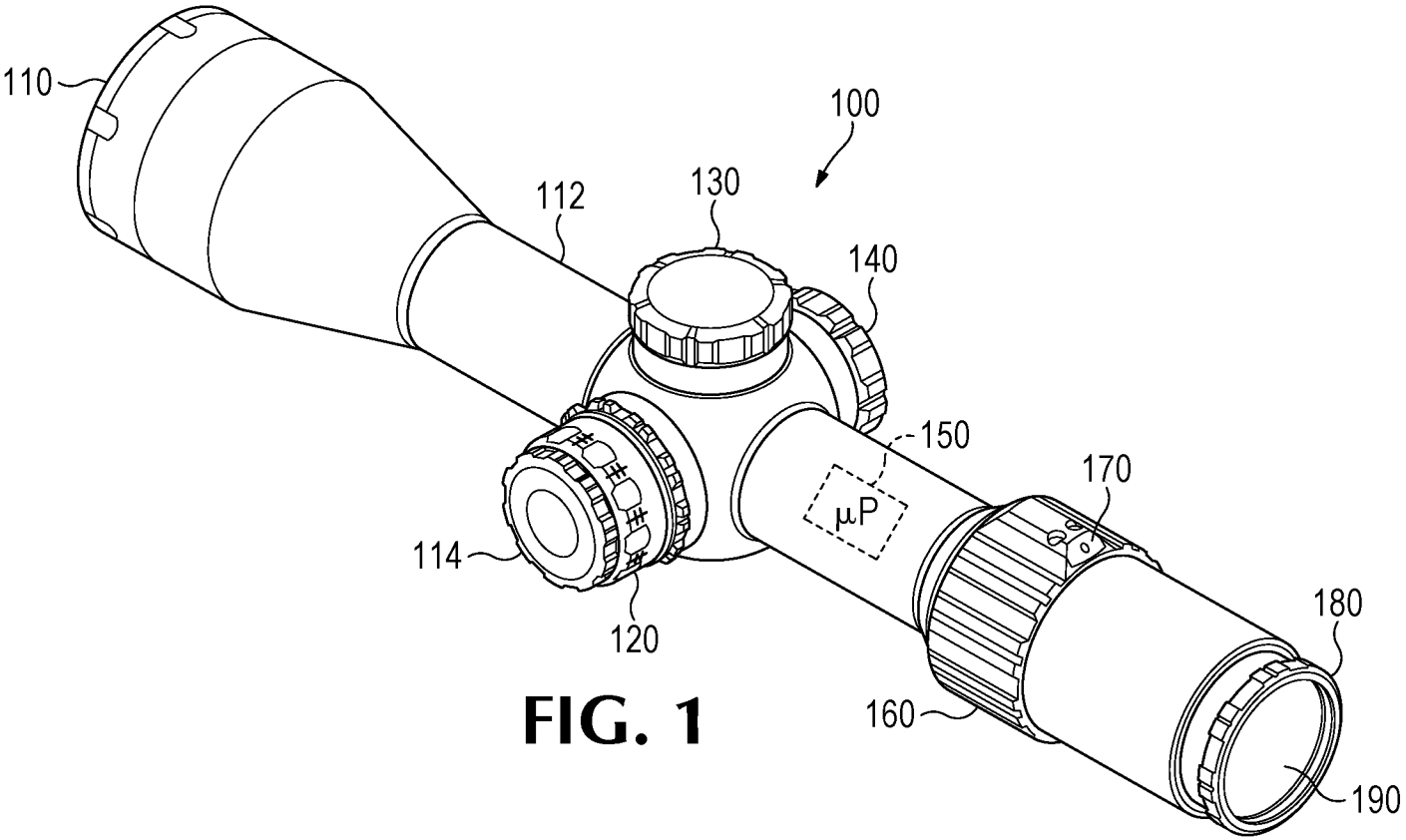
FIG. 1 is a perspective view of a riflescope including stored ballistics groups according to embodiments of the invention.

FIG. 1 is a perspective view of a riflescope including stored ballistics groups according to embodiments of the invention. With reference to FIG. 1, included in an example riflescope 100 are an objective lens 110, main tube 112, battery port cover 114, illumination power selector ring 120, elevation dial 130, wind or windage dial 140, magnification power selector ring 160, wireless communication indicator 170, diopter adjustment 180 and ocular lens 190. Also included is a microprocessor system 150 which functions to operate and control the electronic portion of the scope 100. The microprocessor system 150, as described below, may include one or more microprocessors or microcontrollers, inputs and outputs to operate the riflescope 100.

Figure 2:
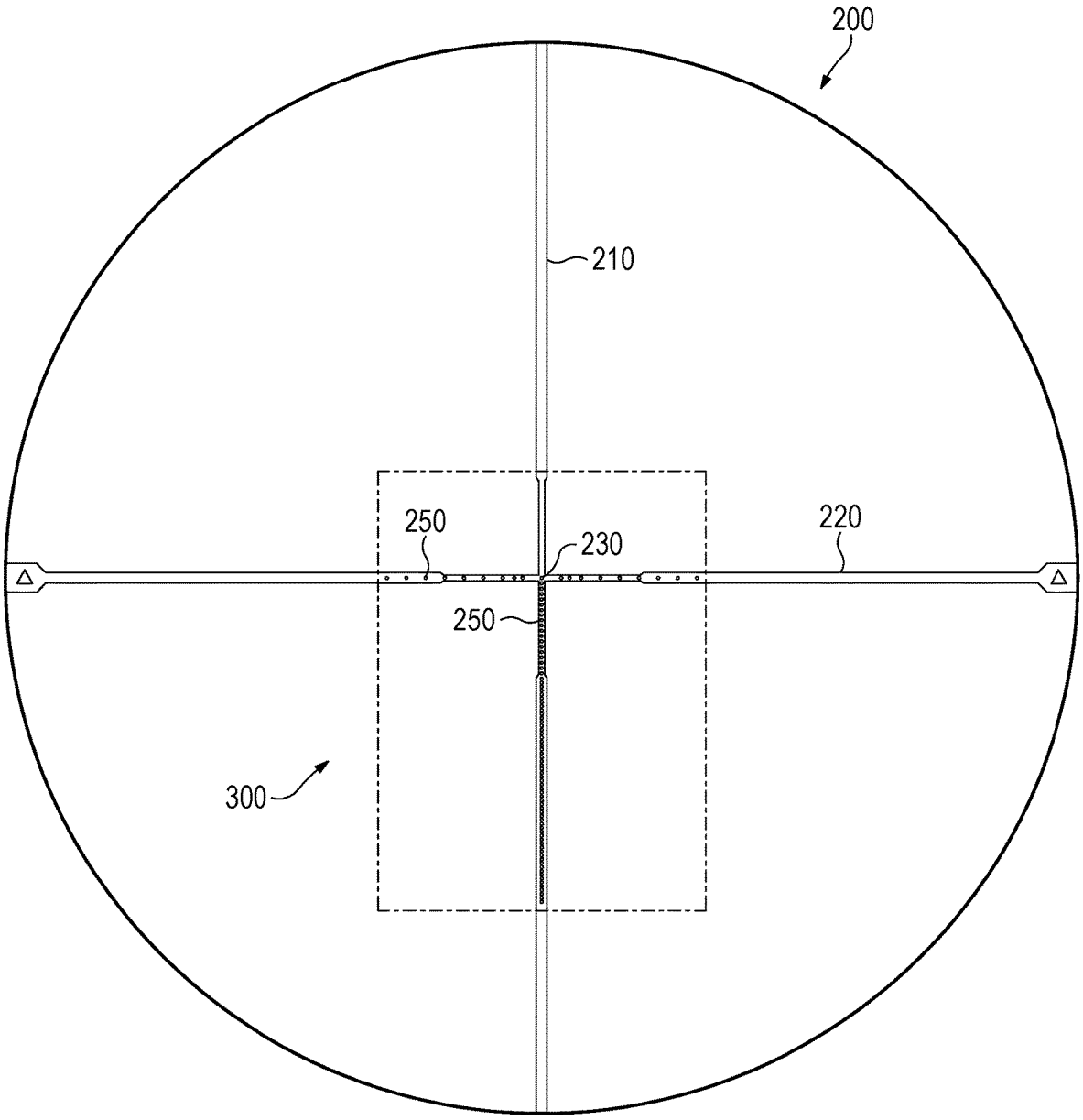
FIG. 2 shows a digital reticle with electronic indicators disposed on a mechanical reticle within the field of view of a digital reticle riflescope according to embodiments of the invention.

FIG. 2 shows a digital reticle 200 having a vertical crosshair 210, horizontal crosshair 220, and center point 230. The crosshairs 210, 220 and center point 230 may be mechanically formed on the reticle 200 or generated by the scope 100. If the crosshairs 210, 220 and/or center point 230 are mechanically formed, then they may be seen at all times, even when the riflescope 100 is powered off.

Figure 3:
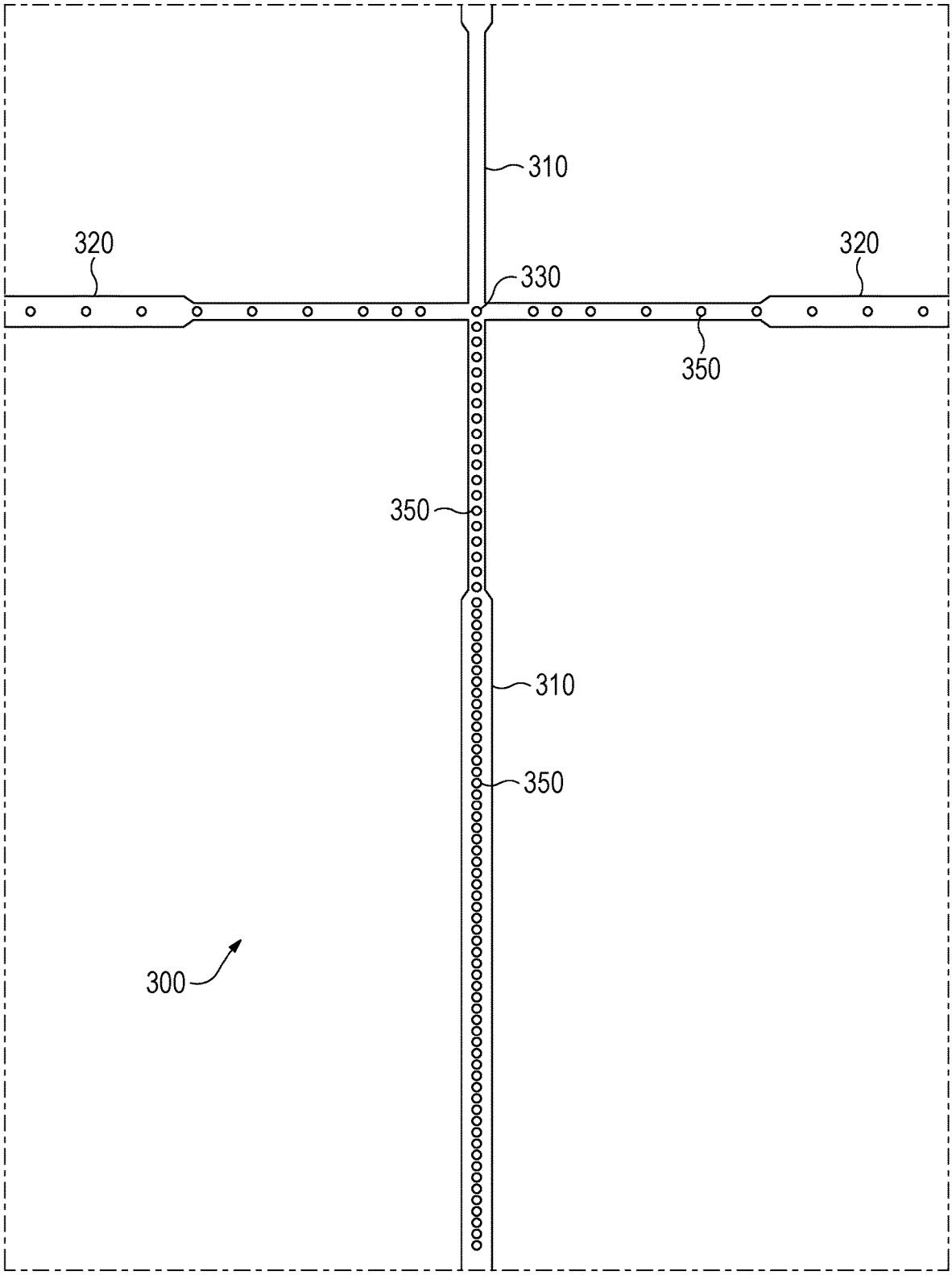
FIG. 3 is a detailed portion of the field of view of the digital reticle riflescope of FIG. 2, according to embodiments of the invention.

The reticle 200 further includes visual indicators 250, such as LEDs overlaid on the crosshairs 210, 220 within the field of view of a digital reticle riflescope 100 according to embodiments of the invention. This reticle 200 may be an example of the reticle viewed through riflescope 100 of FIG. 1. FIG. 3 is a detailed portion of the field of view 300 of the digital reticle riflescope of FIG. 2, illustrating that the reticle includes a number of visual indicators 350 disposed on the reticles 310, 320. These indicators 350 may be individually energized lights, such as LEDs. The visual indicators 350 are also known as holdover dots. An on/off state of the indicators 350 may be controlled by the microprocessor system 150 on the scope 100. Although the visual indicators 350 are indicated in FIGS. 2 and 3 as appearing only on or in conjunction with a mechanical reticle, in some embodiments the visual indicators 350 may appear anywhere within the field of view when viewed through the riflescope.

As mentioned above, the riflescope 100 according to embodiments of the invention include one or more pre-stored ballistic groups. Data for the groups may be stored in memory, such as a non-volatile memory in the microprocessor system 150, for example. As further described below, each ballistic group causes the riflescope 100 to energize a pre-selected set of indicators 350 to be energized to create a visual representation of hold over points at various distances from the target, as described below. These indicators 350 may be energized on the vertical reticle 310, or may appear separate from the vertical reticle. In most cases, however, the indicators 350 will be coincident with the vertical reticle 310, but need not be in all cases, nor are embodiments of the invention so limited.

Choosing different ballistic groups on the riflescope 100 causes the riflescope to energize different sets of indicators 350. For example, choosing Ballistic Group A may cause the riflescope to light the set of indicators 350 contained in S1[0, 1, 2, 3, 5, 10] as enumerated from the center indicator 330. In this instance, S1 means that the center indicator 330 (position 0) will be energized, i.e., visible, as well as the $1^{st}$, $2^{nd}$, $3^{rd}$, $5^{th}$, and $10^{th}$ indicator 350 as counted from the center indicator 330 downward. Other Ballistic Groups are associated with other sets. For example, Ballistic Group B may cause the riflescope 100 to light the set of indicators S2[0, 2, 5, 11, 20, 32]. The above groupings and resultant sets are illustrative. The determination of which sets of indicators 350 are energized for particular groups is determined by a ballistics solution, which may be a ballistics calculator.

By setting the riflescope 100 to the exact or closest pre-stored ballistic group to the actual particular ballistic solution in use by the shooter, the riflescope automatically provides the most accurate, or proper, holdover dots for the shooter to use for various target distances without the necessity of manually entering in a ballistics solution, using a computer application, or having the ballistics solution transferred from another device.

In one embodiment the riflescope 100 includes eight pre-established or pre-stored ballistics groups as illustrated in FIGS. 4A, 4B, and 5. In this embodiment, the first six groups are center-fire groups. Group 1 is the flattest shooting group with the least amount of drop. In this Group 1 the energized indicator holdover dots will be closer together than in other groups for the same target distance. As the group numbers increase, so does the bullet drop, and therefore the energized indicators in the set associated with those groups will be spread further apart. In operation, the user most closely matches the caliber of the cartridge being shot to a list of the groups. Example groups and their corresponding cartridges are illustrated in FIGS. 4A, 4B, and 5, although any groupings could be used depending on the actual implementation. Then, as described below, the user operates the riflescope 100 to cause it to select the desired group. Then, when the user sights through the riflescope, the indicators 350 or holdover dots displayed should closely match the ballistics of the actual cartridge being used. Aiming at the center dot should strike the target if the target is at the calibrated, zeroed-in, distance. Each subsequent dot provides an aiming point for an additional 100 yards. So, the second energized indicator provides an aiming point for the zeroed-in distance plus 100 yards, the third energized indicator provides an aiming point for the zeroed-in distance plus 200 yards, etc. If the discharged rounds are impacting low, a higher number group should be selected. Groups representing muzzleloaders and crossbows may also be included. In one embodiment they are Groups 7 and 8, respectively, which are illustrated in FIG. 5.

Figure 6:
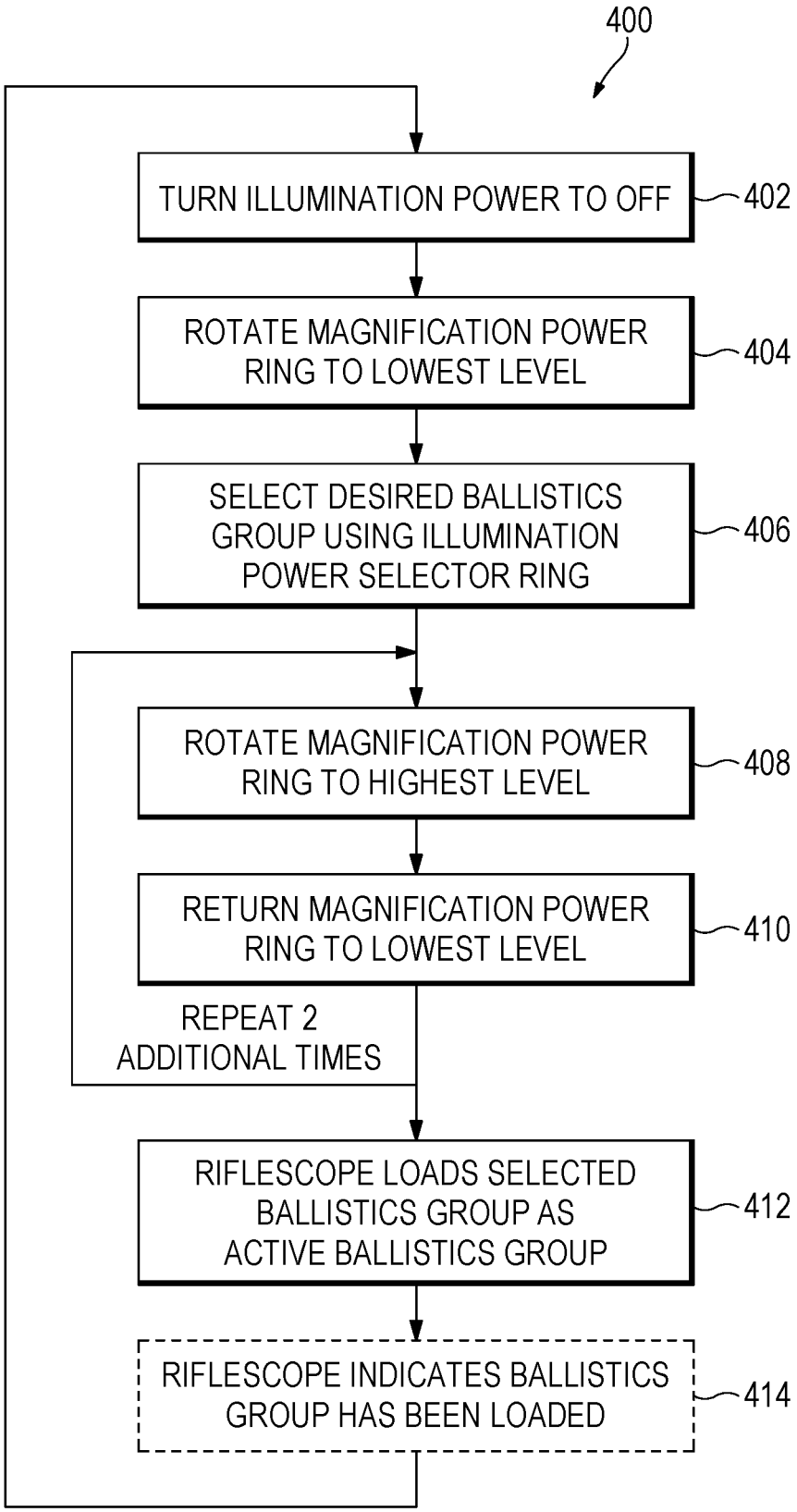
FIG. 6 is a flowchart illustrating example operations used in implementing embodiments of the invention.

Once a ballistic group has been selected for the cartridge, the user sets the riflescope to display the desired ballistics group. This is performed by using various user controls or user inputs described in FIG. 1. A flow 400 illustrated in FIG. 6 illustrates example operations that a user may use to set the riflescope 100 for the particular, desired, ballistics group. With reference to FIGS. 1 and 6, in one embodiment, to select the appropriate group, first the user turns the illumination power selector ring 120 to OFF in an operation 402. Next, the user rotates the magnification power selector ring 160 to the lowest level of magnification until it stops, for example, counterclockwise, in an operation 404. Next the user rotates the illumination power selector ring 120 to the number of the corresponding group desired to be selected in an operation 406. For example, turning the illumination power selector ring 120 to Power level "1" is used to select Group 1, turning the illumination power selector ring 120 to Power level "2" is used to select Group 2, etc. After the desired ballistics group has been selected, the user rotates the magnification power selector ring 160 clockwise to the highest level of magnification in an operation 408, and then back again to the lowest level of magnification in an operation 410. The user repeats the operations of 408 and 110, i.e., to rotate the magnification power selector ring 160 from the lowest power setting to the highest and then back to the lowest two additional times. After the magnification power selector ring 160 has been rotated between the highest and the lowest settings three times, the riflescope 100 loads the selected ballistics group as the active ballistics group in an operation 412. This operation 412 may involve loading a particular set of indicators 350 to a particular memory location in the microprocessor system 150.

In an optional operation 414, the riflescope 100 may indicate that the selection has been made by illuminating an indicator on the riflescope a certain number of times. The indicator may be external to the scope, or may be an indicator made within the reticle itself. In some embodiments, the indicator lights the number of times that corresponds to the selected group—once for Group 1, twice for Group 2, etc.

In some embodiments, the riflescope 100 may additionally include a setting for loading fixed Minute of Angle (MOA) holdover indicators. This setting could be loaded into the riflescope 100 by setting the illumination power selector ring 120 to power level 9. This setting causes the riflescope 100 to activate fixed hold points at zero, 5, 10, 15, and 20 MOA drops.

In one embodiment, after confirming a ballistic group, the reticle will display five indicators 350. As described above, the set of indicators 350 that is energized is based directly on the selected ballistic group. In the embodiment where each set includes five entries, i.e., five indicators 350 are energized based on the selection, the center point 330 is the zero distance and each subsequent illuminated indicator 350 represents an additional 100 yards. For example the second indicator 350 is the zero distance plus 100 yards, the third indicator 350 is the zero distance plus 200 yards, out to a distance of zero distance plus 500 yards for the lowest illuminated dot on the reticle. Of course, the distances provided above are only for explanation. Meters may be substituted for yards, for instance, without deviating from the scope of the invention. Further, although the preferred embodiment is to include five illuminated indicators 350 per selected ballistic group, other embodiments may include more or fewer number of indicators, based on desired implementations.

The user can disable the ballistic groups by using the above process, but the user selects power level 10 on the power selector ring in the operation 406. This causes the riflescope 100 to activate the center point only.

The description given above with reference to operations in the flow 400 is only one example of how the stored ballistics groups within a riflescope 100 may be selected. In other embodiments the desired ballistic group may be selectable by pressing particular buttons, or rotating other rings in other pre-determined patterns on the riflescope 100. Embodiments of the invention may be configured with any predefined pattern of any selectable component on the riflescope 100. Such configuration is performed by recoding or re-programming the microprocessor system 150 of the riflescope 100 to the desired patterns for selecting and storing the desired ballistic group.

Figure 7:
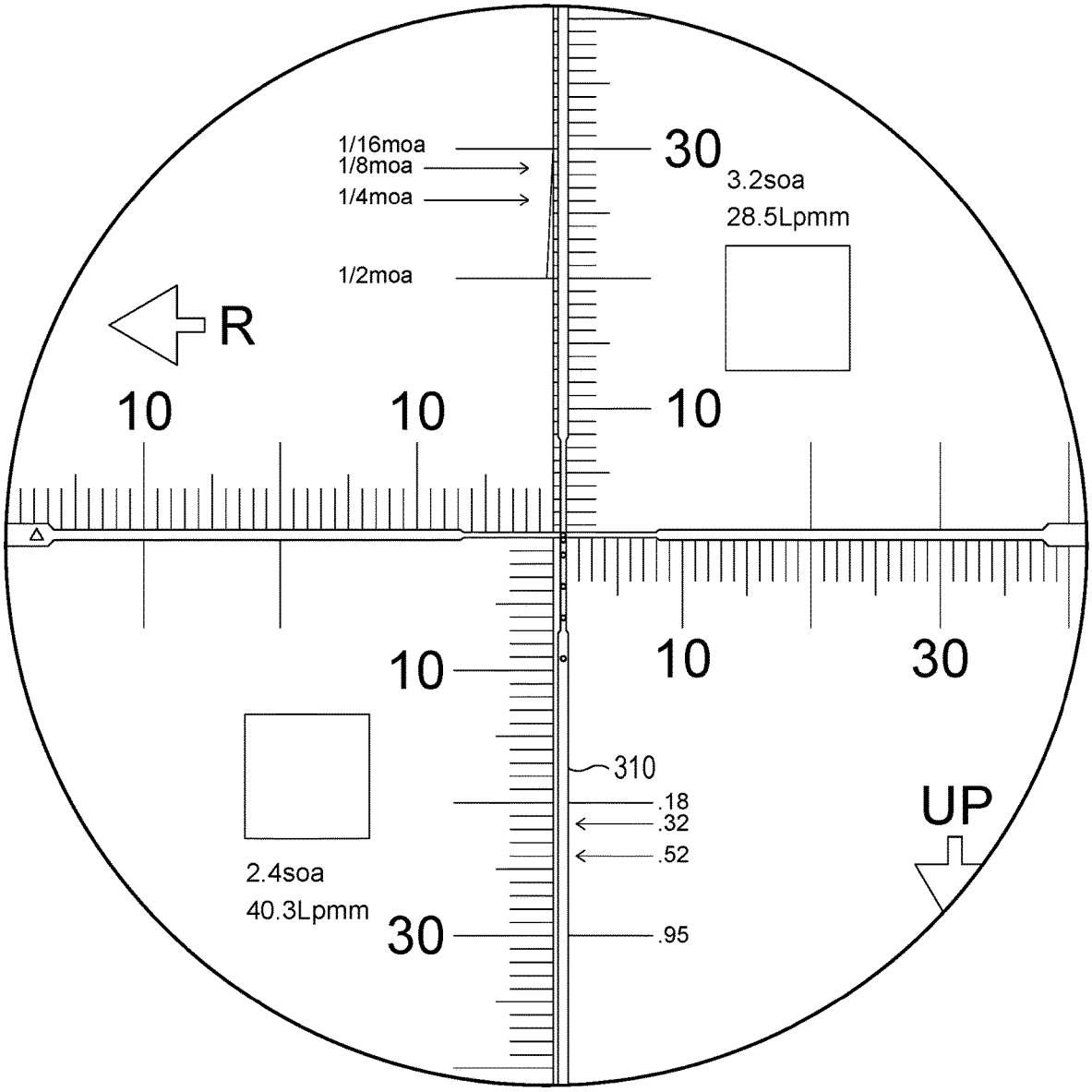
FIG. 7 illustrates a reticle on which a particular ballistics group has been set and certain vertical illumination dots are lit according to the selected group.
Figure 8:
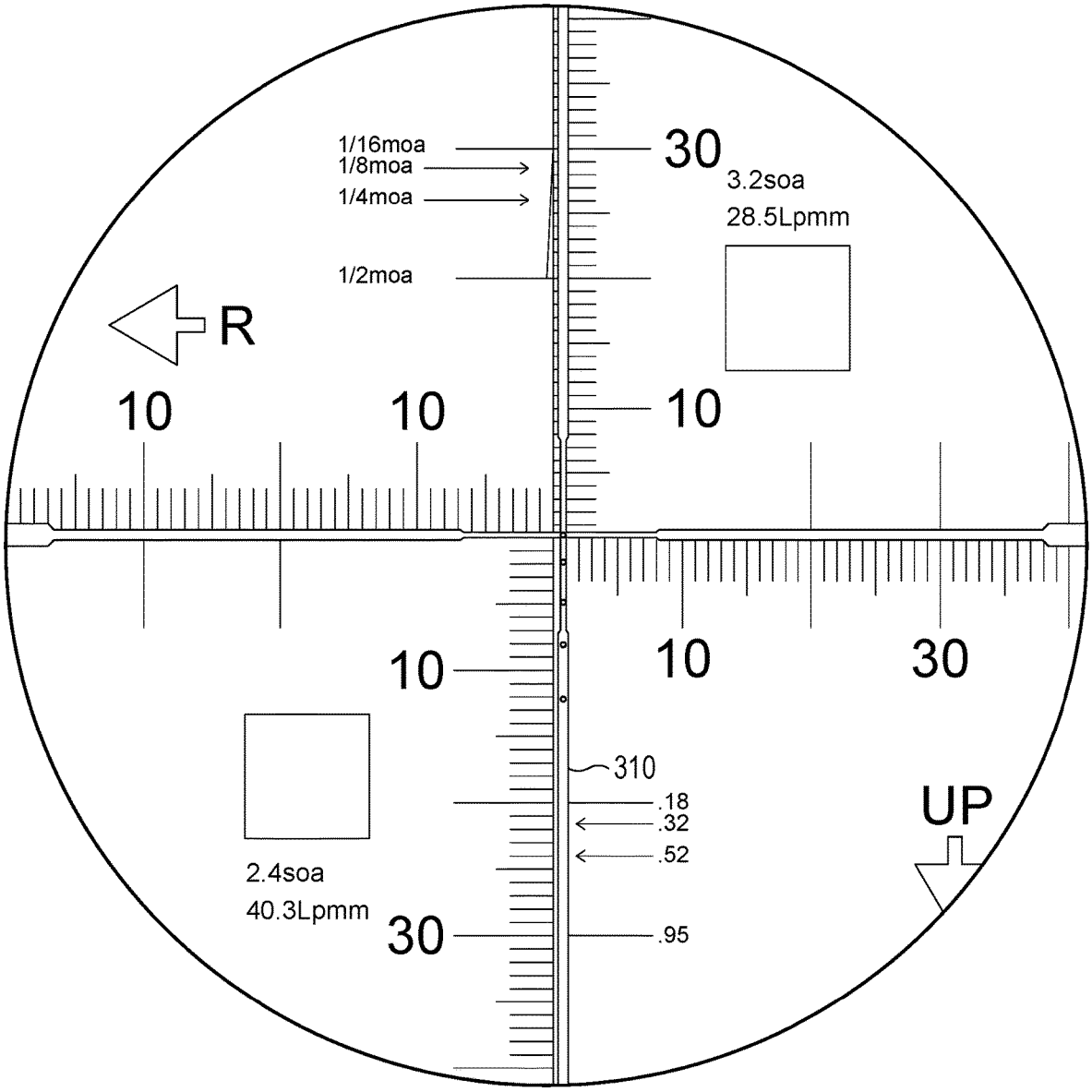
FIG. 8 illustrates a reticle on which another ballistics group has been set and certain vertical illumination dots are lit according to the selected group.
Figure 9:
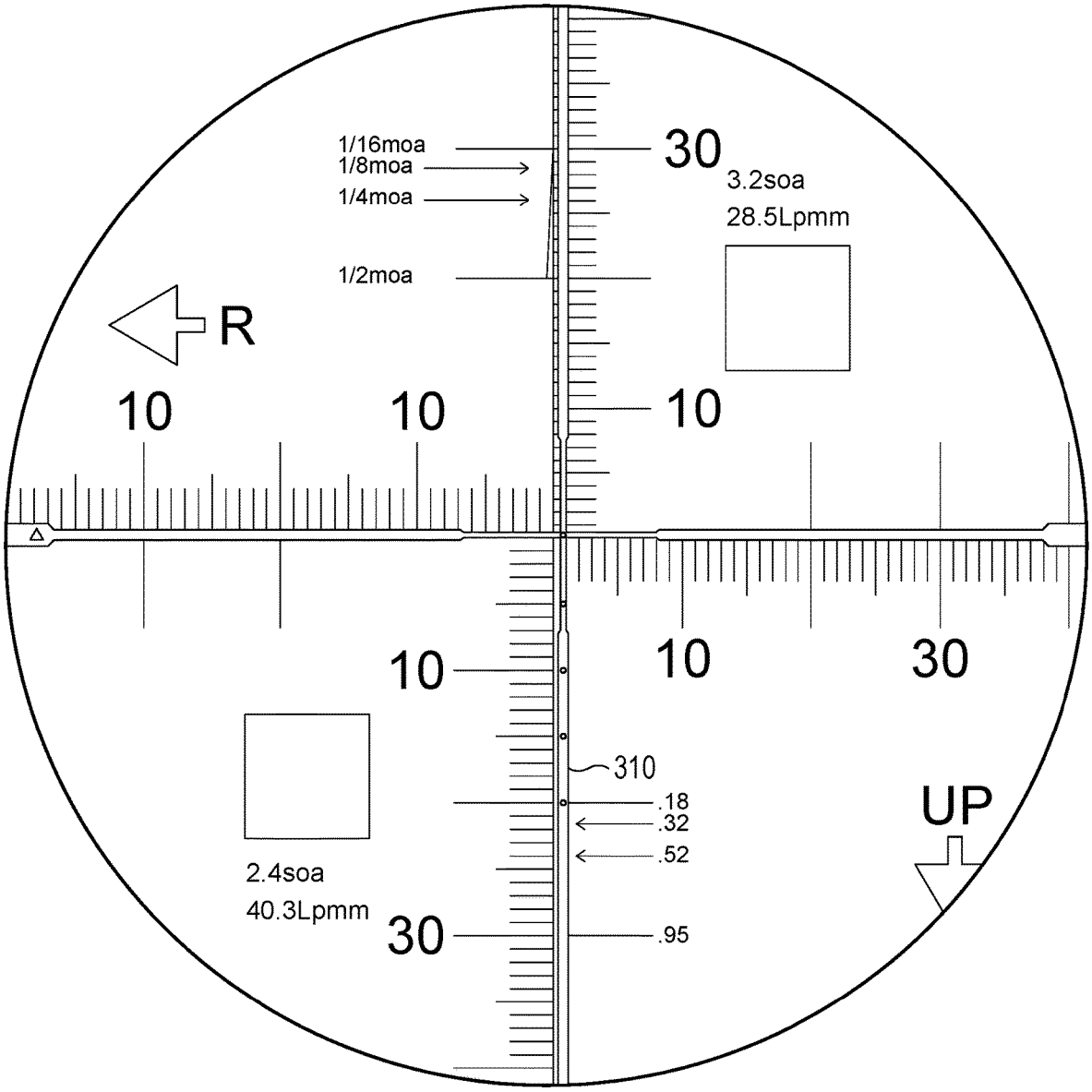
FIG. 9 illustrates a reticle on which yet another ballistics group has been set and certain vertical illumination dots are lit according to the selected group.

FIG. 7 illustrates a reticle on which ballistic Group 3 has been set and certain indicators 350 are lit on the vertical reticle 310 according to the selected group. FIG. 8 illustrates the reticle where Group 6 has been selected, and FIG. 9 illustrates the reticle where Group 9 has been selected. Note how the energized indicators 350 for Group 3 (FIG. 7) are closer together than for Group 6 (FIG. 8), due to less drop associated with the ballistics Group 3 than for Group 6.

Some embodiments of the above-described riflescope may be implemented on one or more scopes described U.S. patent application Ser. No. 16/158,062, which is incorporated by reference herein in its entirety.

Figure 10:
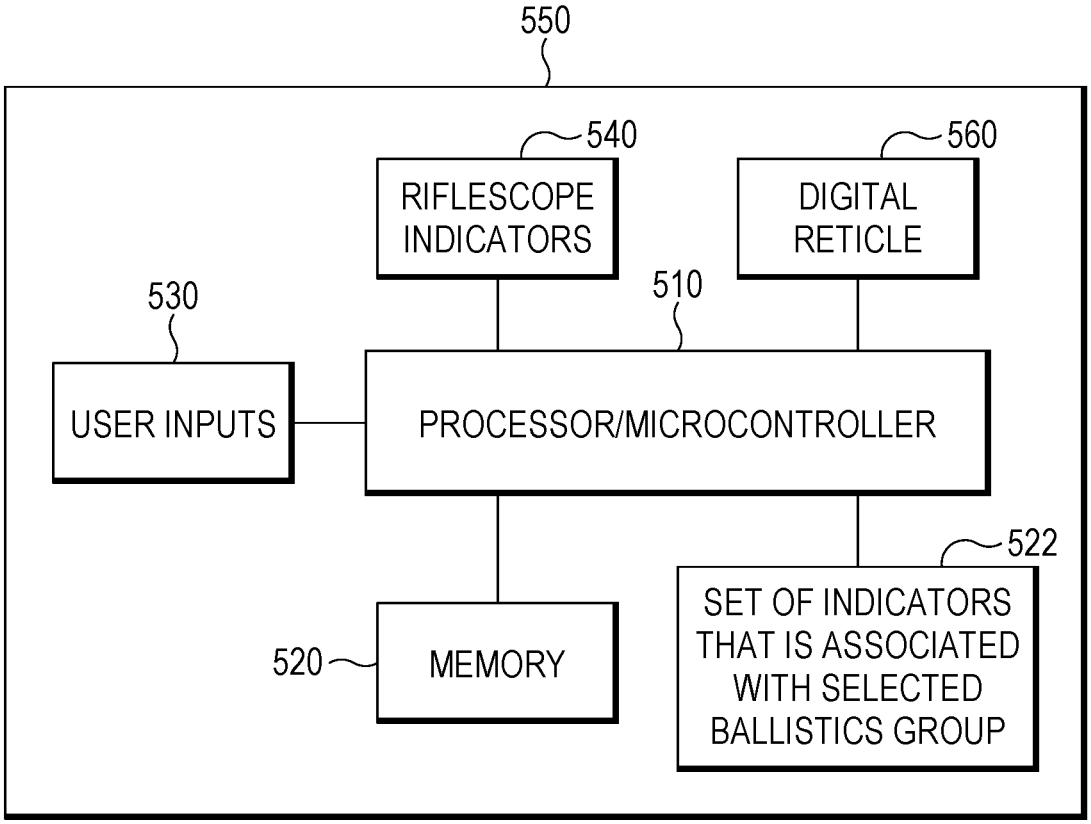
FIG. 10 is a block diagram illustrating processing components of a riflescope including ballistic group storage according to embodiments of the invention.

FIG. 10 is a block diagram of an example processor system 550, which may perform the main operations described in the flow 400 of FIG. 6. In some embodiments the example processor system 550 may be used as the microcontroller or microprocessor system 150 described above.

The processor system 550 includes a central processor or microcontroller 510 configured or programmed to perform the ballistic group storage, ballistic group selection, and presentation of the selected set of indicators 350 that correspond to the selected ballistic group in the reticle of the riflescope 100 described above. Although only one processor 510 is shown in FIG. 10 for ease of illustration, as will be understood by one skilled in the art, any number of processors or microcontrollers 510 of varying types may be used in combination, rather than a single processor.

The processor or microcontroller 510 may be configured to execute instructions from a memory 520 and may perform any methods and/or associated steps indicated by such instructions, such as pre-storing ballistics groups and sets of indicators to be illuminated when each group is selected, allowing the user to select a particular ballistic group from the collection of stored ballistic groups, indicating to the user that a particular ballistic group has been selected, and driving the digital reticle based on the selected group, etc. The memory 520 may be implemented as processor cache, random access memory (RAM), read only memory (ROM), solid state memory, non-volatile memory, such as flash RAM or flash ROM, hard disk drive(s), or any other memory type. In some embodiments the memory 520 is integrated with the processor or microcontroller 510. The memory 520 acts as a medium for storing data, computer program products, and other instructions.

In some embodiments the set of indicators associated with a selected group may be stored in a separate memory 522, which may be non-volatile memory, flash ROM, flash RAM, or any of the other memory types described above. In some embodiments the separate memory 522 stores all of the sets of indicators for each stored ballistic group, and the processor/microcontroller 510 selects only the set that corresponds with the selected ballistic group. In other embodiments only the set of indicators for the selected ballistic group is loaded into the memory 522.

User inputs 530 are coupled to the one or more processors 510. User inputs 530 may include one or more pushbuttons, a selectable menu, touchscreen, and/or any other controls employable by a user to interact with the sight. In some embodiments the user inputs 530 are rings or dials, such as the illumination power selector ring 120, elevation dial 130, wind or windage dial 140, and magnification power selector ring 160 described above with reference to FIG. 1, for example. In some embodiments the user inputs 530 may be made on another device, such as a mobile phone or computer and sent through a communication channel, wired or wireless, to the processor system 550.

The one or more processors 510 may control one or more indicators 540, such as the wireless communication indicator 170 on the riflescope 100, or any other visual indicator on the scope. Such indicators 540 may be used to communicate state of the riflescope, such as which ballistics group is selected, or that the desired ballistics group has been successfully selected. Such indicators 540 may also indicate to the user that there is an error condition with the riflescope 100.

The microprocessor/microcontroller 510 also drives a digital reticle 560. The digital reticle 560 may be an embodiment of the reticle 200 illustrated above, or the reticle illustrated in FIGS. 7-9. In other embodiments the digital reticle 560 may be any type of reticle that communications ballistic group information, such as holdover indicators to the user. Although embodiments of the invention have been described with reference to vertical series or sets of indicators, it is possible that the series or set of illuminated indicator additionally incorporate wind data, in which case the sets of dots would appear as either a line or curve that is angled away from the vertical reticle 310.

The aspects of the present disclosure are susceptible to various modifications and alternative forms. Specific aspects have been shown by way of example in the drawings and are described in detail herein. However, one should note that the examples disclosed herein are presented for the purposes of clarity of discussion and are not intended to limit the scope of the general concepts disclosed to the specific aspects described herein unless expressly limited. As such, the present disclosure is intended to cover all modifications, equivalents, and alternatives of the described aspects in light of the attached drawings and claims.

References in the specification to aspect, example, etc., indicate that the described item may include a particular feature, structure, or characteristic. However, every disclosed aspect may or may not necessarily include that particular feature, structure, or characteristic. Moreover, such phrases are not necessarily referring to the same aspect unless specifically noted. Further, when a particular feature, structure, or characteristic is described in connection with a particular aspect, such feature, structure, or characteristic can be employed in connection with another disclosed aspect whether or not such feature is explicitly described in conjunction with such other disclosed aspect.

EXAMPLES

Illustrative examples of the technologies disclosed herein are provided below. An example of the technologies may include any one or more, and any combination of, the examples described below.

Example 1 is a riflescope including a reticle having a plurality of individually addressable indicators that may be individually energized to produce a visual signal, a memory storing two or more stored sets of ballistics data, each set of ballistics data mapped to a respective set of indicators of the reticle, a selector configured to choose one of the two or more stored sets of ballistics data as an active set of ballistics data, and a driver structured to energize only those indicators of the plurality of indicators that are mapped to the active set of ballistics data.

Example 2 is a riflescope according to Example 1, in which each of the two or more sets of ballistic data comprises up to six data points.

Example 3 is a riflescope according to Examples 1-2, in which each of the up to six data points are mapped to a different one of the plurality of individually addressable indicators.

Example 4 is a riflescope according to Examples 1-3, in which the individually addressable indicators are disposed only on a vertical reticle.

Example 5 is a riflescope according to Examples 1-4, in which the individually addressable indicators are LEDs.

Example 6 is a riflescope according to Examples 1-5, in which the selector uses only components of the riflescope.

Example 7 is a riflescope according to Examples 1-6, in which the active set of ballistics data is stored in non-volatile memory.

Example 8 is a method for presenting an active set of ballistics holdover data in a riflescope that stores a plurality of sets of ballistics holdover data, comprising accepting input from a user indicative of a desired one of the plurality of sets of ballistics holdover data to be the active set of ballistics holdover data, storing the active set of ballistics holdover data in a memory, and driving a set of indicators that are related to the active set of ballistics holdover data.

Example 9 is a method according to Example 8, in which driving a set of indicators comprises driving up to six individually addressable indicators on a reticle of the riflescope.

Example 10 is a method according to Examples 8-9, in which driving a set of indicators comprises driving LED indicators disposed on a vertical crosshair of a reticle of the riflescope.

Example 11 is a method according to Examples 8-10, in which storing the active set of ballistics holdover data in a memory comprises storing the active set of ballistics holdover data in a non-volatile memory.

Example 12 is a method according to Examples 8-11, in which accepting input from a user comprises reading a position of a user controllable component of the riflescope.

Example 13 is a method according to Examples 8-12, in which the user controllable component is a positionable control ring.

Example 14 is a method according to Examples 8-13, further comprising accepting a reset request from a user.

Example 15 is a method according to Example 14, further comprising energizing only a center indicator of a reticle after receiving the reset request.

Additionally, this written description refers to particular features. One should understand that the disclosure in this specification includes all possible combinations of those particular features. For example, where a particular feature is disclosed in the context of a particular aspect, that feature can also be used, to the extent possible, in the context of other aspects.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent, or similar purpose, unless expressly stated otherwise.

In addition, when this application refers to a method having two or more defined steps or operations, the defined steps or operations can be carried out in any order or simultaneously, unless the context excludes those possibilities.

Although specific embodiments have been illustrated and described for purposes of illustration, it will be understood that various modifications may be made without departing from the spirit and scope of the disclosure.

What is claimed is:

1. A riflescope, comprising:

a reticle having a plurality of individually addressable indicators that may be individually energized to produce a visual signal;

a memory storing two or more stored sets of ballistics data, each set of ballistics data mapped to a respective set of indicators of the reticle and each set of ballistics data associated with a pre-defined group label;

a selector configured to choose one of the two or more stored sets of ballistics data as an active set of ballistics data by receiving a single indication of a desired group from a user, in which the desired group is one of the pre-defined group labels, in which the selector is limited to receive only the single indication of desired group from the user, and receives no other ballistics information from the user; and a driver structured to energize only those indicators of the plurality of indicators that are mapped to the active set of ballistics data.

2. The riflescope according to claim 1, in which each of the two or more sets of ballistic data comprises up to six data points.

3. The riflescope according to claim 2, in which each of the up to six data points are mapped to a different one of the plurality of individually addressable indicators.

4. The riflescope according to claim 1, in which the individually addressable indicators are disposed only on a vertical reticle.

5. The riflescope according to claim 1, in which the individually addressable indicators are LEDs.

6. The riflescope according to claim 1, in which the selector uses only components of the riflescope.

7. The riflescope according to claim 1, in which the active set of ballistics data is stored in non-volatile memory.

8. A method for presenting an active set of ballistics holdover data in a riflescope that stores a plurality of sets of ballistics holdover data, the method comprising:

accepting at an input, a single selection from a user indicative of a desired one of the plurality of sets of ballistics holdover data to be the active set of ballistics holdover data, in which the single selection is the only input related to ballistics information that is received from the user;

storing the active set of ballistics holdover data in a memory; and driving a set of indicators that are related to the active set of ballistics holdover data.

9. The method according to claim 8, in which driving a set of indicators comprises driving up to six individually addressable indicators on a reticle of the riflescope.

10. The method according to claim 8, in which driving a set of indicators comprises driving LED indicators disposed on a vertical crosshair of a reticle of the riflescope.

11. The method according to claim 8, in which storing the active set of ballistics holdover data in a memory comprises storing the active set of ballistics holdover data in a non-volatile memory.

12. The method according to claim 8, in which accepting input from a user comprises reading a position of a user controllable component of the riflescope.

13. The method according to claim 12, in which the user controllable component is a positionable control ring.

14. The method according to claim 8, further comprising accepting a reset request from a user.

15. The method according to claim 14, further comprising energizing only a center indicator of a reticle after receiving the reset request.

* * * * *